US011040362B2

(12) United States Patent
Wu

(10) Patent No.: US 11,040,362 B2
(45) Date of Patent: Jun. 22, 2021

(54) ATOMIZING NOZZLE AND ATOMIZING DEVICE COMPRISING SAME

(71) Applicant: Guangzhou DanQ Environmental Technology Co., Ltd., Guangdong (CN)

(72) Inventor: Yong Wu, Guangzhou (CN)

(73) Assignee: GUANGZHOU DANQ ENVIRONMENTAL PROTECTION TECHNOLOGY, Guangzhou (CN)

( * ) Notice: Subject to any disclaimer, the term of this patent is extended or adjusted under 35 U.S.C. 154(b) by 234 days.

(21) Appl. No.: 16/305,009

(22) PCT Filed: Aug. 19, 2016

(86) PCT No.: PCT/CN2016/096110
§ 371 (c)(1),
(2) Date: Nov. 27, 2018

(87) PCT Pub. No.: WO2017/201898
PCT Pub. Date: Nov. 30, 2017

(65) Prior Publication Data

US 2020/0331013 A1 Oct. 22, 2020

(30) Foreign Application Priority Data

May 27, 2016 (CN) ..... 201610371238.4

(51) Int. Cl.
*B05B 7/24* (2006.01)
*B05B 15/30* (2018.01)
(Continued)

(52) U.S. Cl.
CPC ..... *B05B 7/265* (2013.01); *B05B 7/10* (2013.01); *B05B 7/2491* (2013.01); *B05B 7/0416* (2013.01); *B05B 15/30* (2018.02)

(58) Field of Classification Search
CPC ..... B05B 7/265; B05B 7/10; B05B 7/2491; B05B 7/0416; B05B 15/30
See application file for complete search history.

(56) References Cited

U.S. PATENT DOCUMENTS 3,790,086 A * 2/1974 Masai ..... B05B 7/0466 239/406
3,887,135 A 6/1975 Tamai
(Continued)

FOREIGN PATENT DOCUMENTS

CN 1094660 11/1994
CN 101905201 12/2010
(Continued)

OTHER PUBLICATIONS

International Search Report, International Patent Application No. PCT/CN2016/096110, dated Mar. 3, 2017.
(Continued)

*Primary Examiner* — Frederick C Nicolas
(74) *Attorney, Agent, or Firm* — Loza & Loza, LLP; Michael F. Fedrick

(57) ABSTRACT

An atomizing device including an atomizing nozzle is disclosed. The atomizing nozzle includes a spray head and an atomizing nozzle body. The spray head is arranged in the atomizing nozzle body. A through hole in the spray head and a liquid through hole in the atomizing nozzle body form a liquid channel used for delivering liquid. An airtight air channel used for delivering a spiral air flow formed by air is formed in the surface of the spray head and intersects with the liquid channel at an end, provided with the through hole, of the spray head. An air flow is sprayed out via the air channel outside of the sprayer head to form a spiral vortex, so that a siphon suction force is generated to suck liquid in the liquid channel.

11 Claims, 5 Drawing Sheets

(51) Int. Cl.

| | |
|---|---|
| ***B05B 7/26*** | (2006.01) |
| ***B05B 7/10*** | (2006.01) |
| ***B05B 7/04*** | (2006.01) |

(56) References Cited

U.S. PATENT DOCUMENTS 4,157,789 A * 6/1979 Laauwe ..... B05B 11/0032 239/327
4,252,844 A * 2/1981 Nesgood ..... B01F 3/1271 427/213
4,260,110 A * 4/1981 Werding ..... B05B 1/3436 239/404
4,261,517 A * 4/1981 Hopkins ..... F23D 11/007 239/406
4,396,152 A * 8/1983 Abplanalp ..... B65D 83/60 239/337
4,415,122 A * 11/1983 Laauwe ..... B05B 11/043 239/327
4,479,773 A * 10/1984 Tamai ..... B05B 7/0861 239/403
4,546,923 A * 10/1985 Ii ..... B05B 7/066 239/406
5,183,186 A * 2/1993 Delaney, Jr. ..... B05B 11/043 222/211
5,814,121 A * 9/1998 Travis ..... F23D 14/32 65/346
7,191,959 B2 * 3/2007 Kutay ..... B05B 7/2416 239/10
7,677,471 B2 * 3/2010 Prociw ..... F23D 11/107 239/406
8,057,220 B2 * 11/2011 Bretz ..... B05B 7/10 431/159
2013/0284766 A1 * 10/2013 Dubois ..... B05B 9/0861 222/386.5
2019/0134652 A1 * 5/2019 Busby ..... B05B 7/2489

FOREIGN PATENT DOCUMENTS

CN 102091678 12/2011
CN 105797887 7/2016

OTHER PUBLICATIONS

International Written Opinion, International Patent Application No. PCT/CN2016/096110, dated Mar. 3, 2017.

* cited by examiner

ATOMIZING NOZZLE AND ATOMIZING DEVICE COMPRISING SAME

CROSS-REFERENCE TO RELATED APPLICATIONS

This application is the U.S. national stage of International Patent Application No. PCT/CN2016/096110, filed on Aug. 19, 2016 and entitled ATOMIZING NOZZLE AND ATOMIZING DEVICE COMPRISING SAME, which claims the benefit of priority under 35 U.S.C. § 119 from Chinese Patent Application No. 201610371238.4, filed May 27, 2016. The disclosures of the foregoing applications are incorporated herein by reference in their entirety.

BACKGROUND OF THE INVENTION

Technical Field

The invention belongs to the technical field of atomizing devices, and particularly relates to an atomizing nozzle and an atomizing device comprising the same.

Description of Related Art

Chinese Utility Model Patent Application No. 2010202819325 discloses an atomizer used for atomizing essences or essential oil. The atomizer used for atomizing essences or essential oil comprises an atomizer body, wherein a first cavity and a second cavity are formed in the atomizer body, an atomizing air outlet is formed in the top wall of the first cavity, and a backflow through hole is formed in the bottom wall of the first cavity; a baffle is arranged on the upper portion of the first cavity and is spaced from the top wall of the first cavity, a top chamber is formed between the baffle and the top wall of the first cavity, a bottom chamber is formed between the baffle and the bottom wall of the first cavity, and a through hole is formed between the top chamber and the bottom chamber; an air flow spray hole is formed in the side wall of the bottom chamber, and the bottom chamber is communicated with the bottom of the second cavity through the air flow spay hole; an air flow spray head is fixed in the second cavity and is spaced from the bottom wall of the second cavity, and an atomizing cavity is formed between the air flow spray head and the bottom wall of the second cavity; and a liquid pipe is arranged on the atomizer body and is communicated with the atomizing cavity.

Chinese Invention Patent Application No. 2004800110063 discloses a spraying device which comprises a liquid container, a liquid delivery hose and a diffusion opening, wherein the liquid delivery hose is used for delivering liquid to a spraying area, the diffusion opening formed in the spraying area, a sprayed liquid particle stream is diffused out of the spraying area via the diffusion opening, and the diffusion opening is located in a space above the liquid level in the liquid container. The liquid container comprises a sprayed liquid particle release opening, wherein sprayed liquid particles from the diffusion opening flow out of the liquid container via the release opening.

From the above description, a negative pressure generated by air is used for atomizing liquid in the prior art, a high atomizing capacity can be realized only if high-pressure air is provided, and in this case, peripheral air supply equipment such as a large-parameter air pump is needed, the noise of the spraying device is increased, the service life of the air pump is shortened, the atomizing cost is increased, and particles atomized purely by the negative pressure are non-uniform.

BRIEF SUMMARY OF THE INVENTION

In view of this, the main objective of the invention is to provide an atomizing nozzle and an atomizing device comprising the same.

To fulfill the above objective, the following technical solution is adopted by the invention.

An embodiment of the invention provides an atomizing nozzle. The atomizing nozzle comprises a spray head and an atomizing nozzle body. The spray head is arranged in the atomizing nozzle body. A through hole in the spray head and a liquid through hole in the atomizing nozzle body form a liquid channel used for delivering liquid. An airtight air channel used for delivering a spiral air flow formed by air is formed in the surface of the spray head. The air channel intersects with the liquid channel at an end, provided with the through hole, of the spray head.

Wherein, the through hole used for delivering liquid sucked by a siphon suction force is formed in the center of the spray head, and a plurality of oblique grooves used for forming a spiral vortex with air to generate an air flow possessing the siphon suction force are formed in the top of the spray head in the circumferential direction.

Wherein, the atomizing nozzle further comprises a container used for providing liquid, and the container is communicated with the liquid through hole of the atomizing nozzle body through a hose.

Wherein, an atomizer shell is arranged at the top of the atomizing nozzle body and is provided with a mist outlet. The lower end of the mist outlet is communicated with an atomizing outlet of the atomizing nozzle body through a channel. The atomizer shell is horizontally provided with an air inlet channel communicated with an air inlet of the atomizing nozzle body.

Wherein, the spray head is sleeved with a spray cap provided with an atomizing hole. The spray cap is matched with the spray head to form an atomizing cavity. Air ducts used for outputting air are formed by an oblique inner surface of the spray cap and the oblique grooves of the spray head.

Wherein, the atomizing nozzle is provided with a guide channel. The guide channel is fixed in the atomizing nozzle body and has an end communicated with the liquid through hole of the atomizing nozzle body and an end communicated with the through hole of the spray head.

An atomizing device comprises a box and the atomizing nozzle. The box comprises an atomizing device body and a front cover. The atomizing device body is hinged to the front cover. An air pump is arranged in the atomizing device body and is provided with an air outlet extending out of the atomizing device body. The atomizing nozzle is arranged on the atomizing device body and is communicated with the air outlet of the air pump.

Wherein, the atomizing device body is provided with a fixed beam to be connected with a convex edge of the atomizer shell of the atomizing nozzle. When the atomizer shell is mounted in the fixed beam, the air inlet channel is communicated with the air outlet of the air pump.

Wherein, the front cover is provided with a round hole used for configuring the mist outlet of the atomizing nozzle.

Wherein, the atomizing device body is internally provided with a time controller used for controlling the work time and work interval of the atomizing device and is also provided with a fixing structure used for fixing the atomizing nozzle.

Wherein, the atomizing device body is further internally provided with a fan used for accelerating diffusion of atomizing air.

Compared with the prior art, the invention has the following beneficial effects:

An air flow at a certain pressure is sprayed out via the air channel outside of the sprayer head to form a spiral vortex, so that a siphon suction force is generated to suck liquid in the liquid channel, and thus, a large atomizing capacity is realized under a low pressure (20-30 KPa), and the atomizing efficiency is high; and the atomizing nozzle is easy to replace, low in noise and capable of atomizing different types of liquid such as essential oil, deodorants and bactericides, and atomized particles are uniform.

REFERENCE SIGNS

Figure 1:
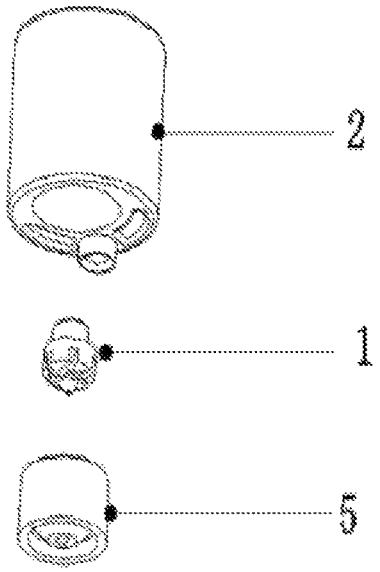
FIG. 1 is a structural view of an atomizing nozzle provided by an embodiment of the invention.

1—spray head, 101—through hole, 102—oblique groove, 2—atomizing nozzle body, 201—liquid through hole, 3—container, 301—hose, 302—liquid suction funnel, 4—atomizer shell, 401—mist outlet, 402—air inlet, 5—spray cap, 501—atomizing hole, 6—box, 601—atomizing device body, 602—front cover, 603—fixed beam, 604—round hole, 7—guide channel, 701—liquid channel, 8—air inlet channel, 9—air outlet nozzle.

DETAILED DESCRIPTION OF THE INVENTION

For a better understanding of the objectives, technical solutions and advantages of the invention, the invention is further expounded below with reference to the accompanying drawings and embodiments. It is understood that the specific embodiments in the following description are only used to explain the invention, but are not intended to limit the invention.

One embodiment of the invention provides an atomizing nozzle. As shown in FIGS. 1, 2, 3 and 4, the atomizing nozzle comprises a spray head 1 and an atomizing nozzle body 2. The spray head 1 is arranged in the atomizing nozzle body 2. A through hole 101 in the spray head 1 and a liquid through hole 201 in the atomizing nozzle body 2 form a liquid channel 701 used for delivering liquid. An airtight air channel used for delivering a spiral air flow formed by air is formed in the surface of the spray head 1. The air channel intersects with the liquid channel 701 at an end, provided with the through hole 101, of the spray head 1.

The atomizing nozzle body 2 is used for fixing the spray head 1 and separating air and liquid from atomized air.

Figure 2:
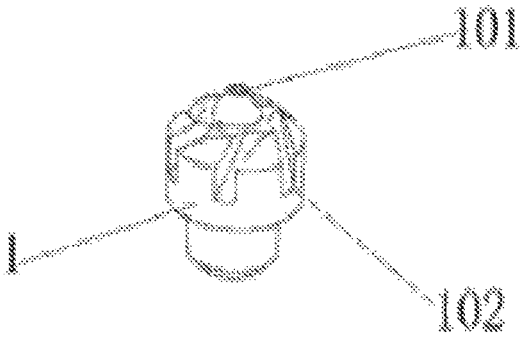
FIG. 2 is a structural view of a spray head provided by the embodiment of the invention.
Figure 3:
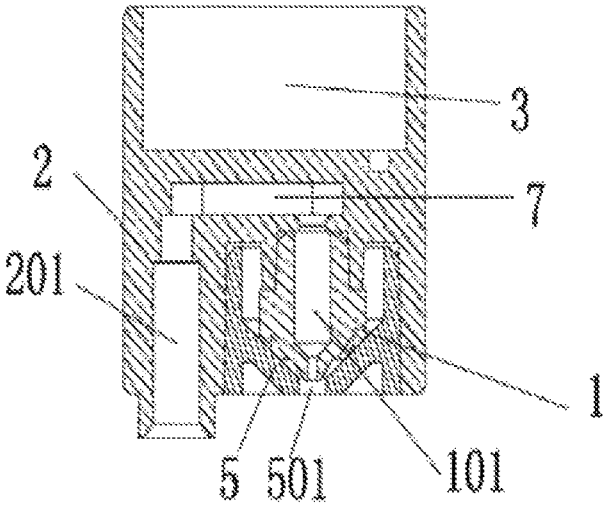
FIG. 3 is a sectional view of the atomizing nozzle provided by the embodiment of the invention.
Figure 4:
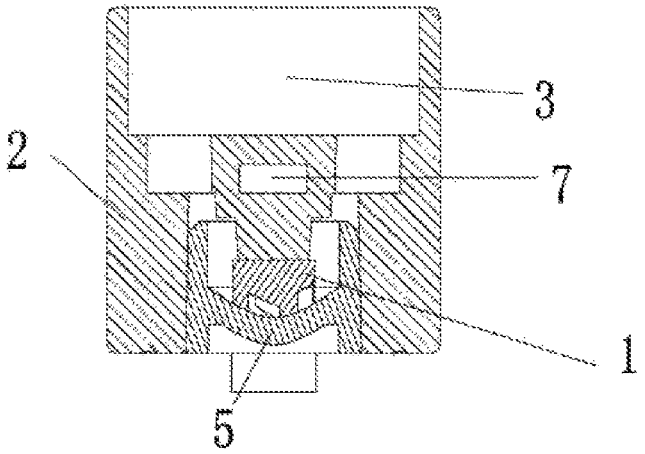
FIG. 4 is another sectional view of the atomizing nozzle provided by the embodiment of the invention.
Figure 5:
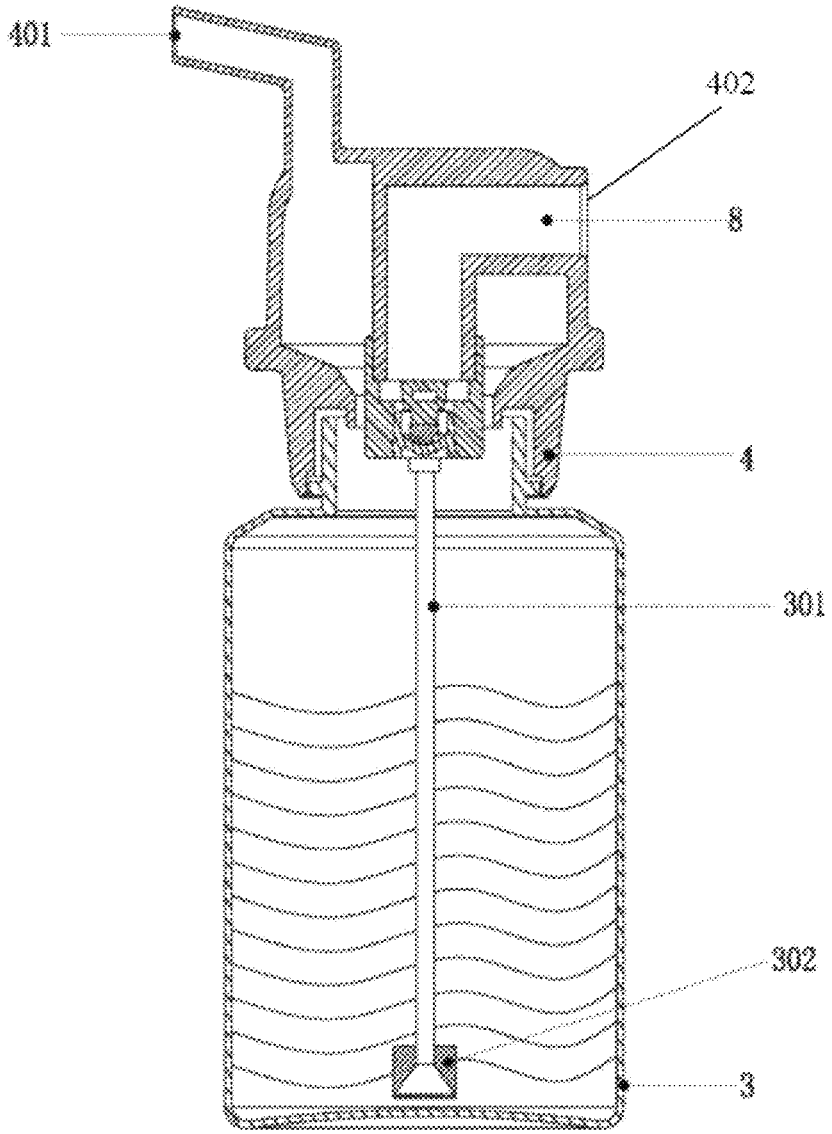
FIG. 5 is a sectional view of a container to be connected with the atomizing nozzle provided by the embodiment of the invention.
Figure 6:
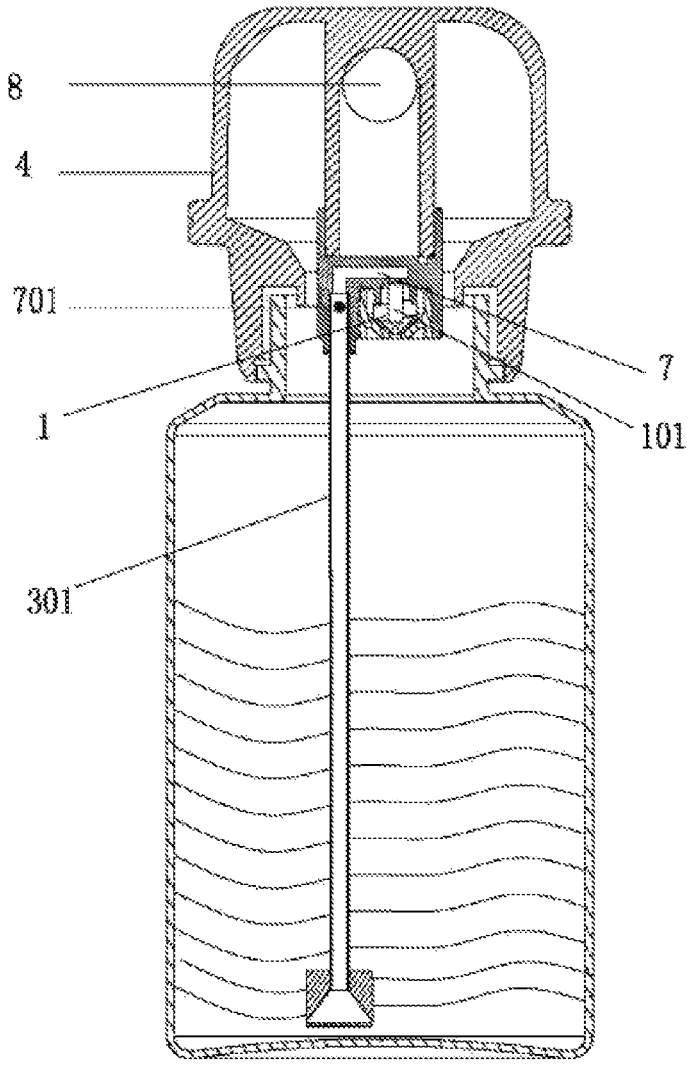
FIG. 6 is another sectional view of the container to be connected with the atomizing nozzle provided by the embodiment of the invention.
Figure 7:
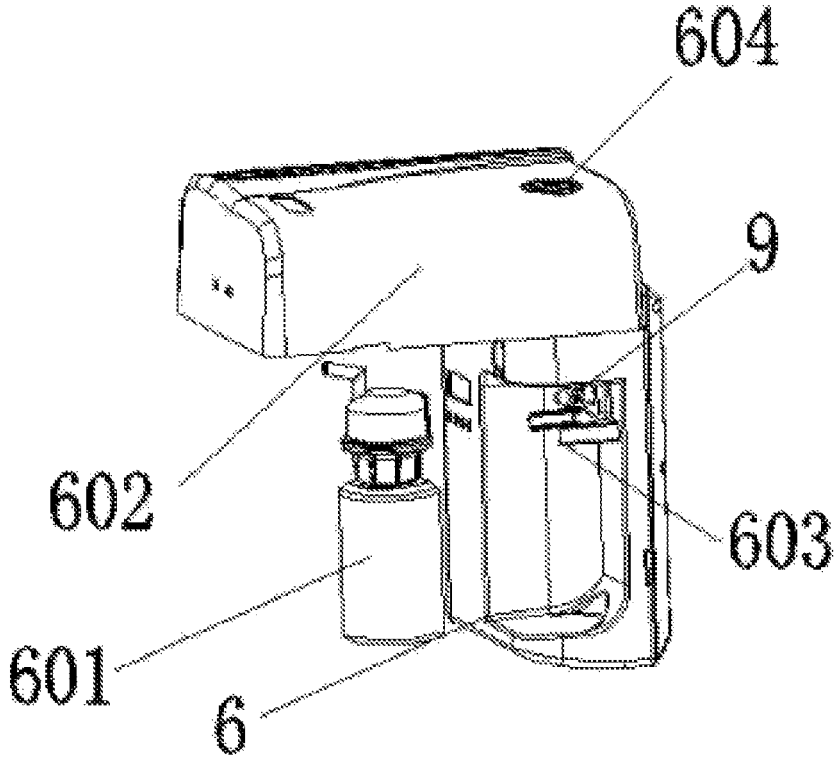
FIG. 7 is separated view of an atomizing nozzle and a box of an atomizing device provided by the embodiment of the invention.

As shown in FIG. 2, the through hole 101 used for delivering liquid sucked by a siphon suction force is formed in the center of the spray head 1, and a plurality of oblique grooves 102 used for forming a spiral vortex with air to generate an air flow possessing the siphon suction force are formed in the top of the spray head 1 in the circumferential direction.

Air is sprayed out in a staggered manner via the oblique grooves 102 in the surface of the spray head 1 to form an air flow possessing a shearing force and to apply a siphon suction force to the through hole 101 in the center of the spray head 1, so that liquid is sucked out via the liquid channel 701 and is then sheared by the air flow to form a uniform atomizing air flow.

The atomizing nozzle further comprises a container 3 used for providing liquid. The container 3 is communicated with the liquid through hole 201 of the atomizing nozzle body 2 through a hose 301.

In this application, liquid in the container 3 is delivered through the hose 301. After a siphon suction force is generated at the through hole 101, liquid in the container 3 is sprayed out via the through hole 101 in the center of the spray head 1 after passing through the hose 301 and the liquid channel 701.

In this application, the container 3 is arranged at the lower end of the atomizing nozzle body 2 and is spirally connected with an atomizer shell 4. Particularly, the liquid through hole 201 of the atomizing nozzle body 2 is in close contact and connection with one end of the hose 301, and the other end of the hose 301 is located in the container 3 to suck liquid in the container 3.

The hose 301 is arranged below the atomizing nozzle body 2 and extends into the container 3, and a liquid suction funnel 302 is reversely arranged at the tail end of the hose 301.

The atomizer shell 4 is arranged at the top of the atomizing nozzle body 2 and is provided with a mist outlet 401. The lower end of the mist outlet 401 is communicated with an atomizing outlet of the atomizing nozzle body 2 through a channel. The atomizer shell 4 is horizontally provided with an air inlet channel 8 communicated with an air inlet 402 of the atomizing shell body 2.

The atomizer shell 4 is fixed to the upper end of the atomizing nozzle body 2. The air inlet channel 8 formed in the atomizer shell 4 is communicated with the upper end of the atomizing nozzle body 2 to guide air into the atomizing nozzle body 2, and then the air is sprayed out via air ducts of the spray head 1.

The spray head 1 is sleeved with a spray cap 5 provided with an atomizing hole 501. The spray cap 5 is matched with the spray head 1 to form an atomizing cavity. The air ducts used for outputting air are formed by an oblique inner surface of the spray cap 5 and the oblique grooves 102 of the spray head 1. Other configurations can also be adopted as long as the oblique grooves 102 of the spray head 1 can be sealed to form the air ducts for stable air output.

Wherein, the atomizing nozzle is provided with a guide channel 7. The guide channel is fixed in the atomizing nozzle body 2 and has an end communicated with the liquid through hole 201 of the atomizing nozzle body 2 and an end communicated with the through hole 101 of the spray head 1.

The guide channel 7 is a cavity having two ends provided with holes. When the hose 301 penetrates through the liquid through hole 201 of the atomizing nozzle body 2 or is communicated with the liquid through hole 201 of the atomizing nozzle body 2, the through hole 101 in the other end of the guide channel 7 is communicated with the through hole 101 in the center of the spray head 1 to form the liquid channel 701, and liquid in the container 3 can be guided out through the liquid channel 701 so as to be sprayed out via the through hole 101 of the spray head 1.

Embodiment 2

An atomizing device comprises a box 6 and the atomizing nozzle. The box 6 comprises an atomizing device body 601 and a front cover 602. The atomizing device body 601 is hinged to the front cover 602. An air pump is arranged in the atomizing device body 601 and is provided with an air outlet extending out of the atomizing device body 601. The atomizing nozzle is arranged on the atomizing device body 601 and is communicated with the air outlet of the air pump.

Atomizing air of the atomizing nozzle is output upwards from the lower end of the atomizing nozzle body 2 and is then output through the atomizer shell 4.

The atomizing device body 601 is provided with a fixed beam 603 to be matched with a convex edge of the atomizer shell 4 of the atomizing nozzle. When the atomizer shell 4 is mounted in the fixed beam 603, the air inlet channel 8 is communicated with the air outlet of the air pump.

The front cover 602 is provided with a round hole 604 used for configuring the mist outlet 401 of the atomizing nozzle.

The atomizing device body 601 is internally provided with a time controller used for controlling the work time and work interval of the atomizing device and is also provided with a fixing structure used for fixing the atomizing nozzle.

The atomizing device body 601 is further internally provided with a fan used for accelerating diffusion of atomizing air.

The aforesaid description only refers to preferred embodiments of the invention and is not intended to limit the protection scope of the invention.

What is claimed is:

1. An atomizing nozzle comprising a spray head and an atomizing nozzle body, wherein the spray head is arranged in the atomizing nozzle body, further comprising a through hole in the spray head and a liquid through hole in the atomizing nozzle body forming a liquid channel used for delivering liquid, wherein an airtight air channel used for delivering a spiral air flow formed by air is formed in a surface of the spray head, and wherein the air channel intersects with the liquid channel at an end provided with the through hole of the spray head, wherein the atomizing nozzle further comprises a container used for providing liquid, the container being in communication with the liquid through hole of the atomizing nozzle body through a hose, and wherein an atomizer shell is arranged at a top of the atomizing nozzle body and is provided with a mist outlet, a lower end of the mist outlet is in communication with an atomizing outlet of the atomizing nozzle body, and the atomizer shell is provided with an air inlet channel in communication with an air inlet of the atomizing nozzle body.

2. The atomizing nozzle according to claim 1, wherein the through hole used for delivering liquid sucked by a siphon suction force is formed in a center of the spray head, and a plurality of oblique grooves used for forming a spiral vortex with air to generate an air flow possessing the siphon suction force are formed in a top of the spray head in a circumferential direction.

3. The atomizing nozzle according to claim 1, wherein the spray head is sleeved with a spray cap provided with an atomizing hole, the spray cap is matched with the spray head to form an atomizing cavity, and air ducts used for outputting air are formed by an oblique inner surface of the spray cap and the oblique grooves of the spray head.

4. The atomizing nozzle according to claim 2, wherein the atomizing nozzle is provided with a guide channel, and the guide channel is fixed in the atomizing nozzle body and has an end in communication with the liquid through hole of the atomizing nozzle body and an end in communication with the through hole of the spray head.

5. An atomizing device, comprising a box and the atomizing nozzle according to claim 1, wherein the box comprises an atomizing device body and a front cover, the atomizing device body is hinged to the front cover, an air pump is arranged in the atomizing device body and is provided with an air outlet extending out of the atomizing device body, and the atomizing nozzle is arranged on the atomizing device body and is in communication with the air outlet of the air pump.

6. The atomizing device according to claim 5, wherein the atomizing device body is provided with a fixed beam to be matched with a convex edge of the atomizer shell of the atomizing nozzle, and wherein when the atomizer shell is mounted in the fixed beam, the air inlet channel is in communication with the air outlet of the air pump.

7. The atomizing device according to claim 5, wherein the front cover is provided with a round hole used for configuring the mist outlet of the atomizing nozzle.

8. The atomizing device according to claim 7, wherein the atomizing device body is internally provided with a time controller used for controlling a work time and a work interval of the atomizing device and is also provided with a fixing structure used for fixing the atomizing nozzle.

9. The atomizing device according to claim 8, wherein the atomizing device body is further internally provided with a fan used for accelerating diffusion of atomizing air.

10. The atomizing nozzle according to claim 2, wherein the atomizing nozzle further comprises the container used for providing the liquid, and the container is in communication with the liquid through hole of the atomizing nozzle body through the hose.

11. The atomizing device according to claim 6, wherein the front cover is provided with a round hole used for configuring the mist outlet of the atomizing nozzle.

* * * * *